United States Patent [19]

Nishikawa

[11] Patent Number: 4,538,441

[45] Date of Patent: Sep. 3, 1985

[54] REDRAWING-IRONING APPARATUS

[75] Inventor: Horotaka Nishikawa, Sagamihara, Japan

[73] Assignee: Toyo Seikan Kaisha Limited, Tokyo, Japan

[21] Appl. No.: 619,969

[22] Filed: Jun. 12, 1984

[51] Int. Cl.[3] ..... B21D 22/00

[52] U.S. Cl. ..... 72/349; 72/481

[58] Field of Search ..... 72/347, 348, 349, 473, 72/481

[56] References Cited

U.S. PATENT DOCUMENTS 4,043,169 8/1977 Gorgius ..... 72/347
4,057,022 11/1977 Koshino ..... 72/379
4,248,076 2/1981 Bulso ..... 72/349
4,372,143 2/1983 Elert ..... 72/349

*Primary Examiner*—Leon Gilden
*Attorney, Agent, or Firm*—Armstrong, Nikaido, Marmelstein & Kubovcik

[57] ABSTRACT

In a redrawing-ironing apparatus provided with a punch fixed on a ram, a die means including a redrawing die and ironing dies, an annular piston for fastening the die means, a cup retained pad adapted to push the inner periphery of the bottom of a drawn cup placed on the redrawing die, and pins fixed on the annular piston and extending axially, the free end surface of the pin is engaged with the flange of the cup retainer pad at the end of the redrawing. As a result, the earing portions of the drawn cup can be prevented from being thinned and broken into fragments at the redrawing.

2 Claims, 6 Drawing Figures

| FIG. 2A | FIG. 2B |
|---|---|

REDRAWING-IRONING APPARATUS

BACKGROUND OF THE INVENTION

This invention relates to a redrawing-ironing apparatus and, more particularly, to an improved redrawing-ironing apparatus in which earing portions can be prevented from being extended too thin into fragments at the end of a redrawing process of a drawn cup.

A drawn-ironed can body which is used extensively of late for carbonated beverage cans, beer cans and the like is usually formed by redrawing and then ironing in two or three steps a drawn cup formed from a metallic blank such as of aluminum alloy sheet or tinplate, on a redrawing-ironing apparatus. The diameter of the cup after redrawing becomes somewhat smaller (the inside diameter being equal to that of the drawn-ironed can body), and its height becomes somewhat larger by redrawing. So as to prevent wrinkles from arising on the bottom during the forming, the cup is redrawn while the inside periphery of its bottom is pushed under fluid pressure between a retainer pad and the surface of a redrawing die.

At the end of the redrawing process, an excessively high pressure is exerted on earing portions of the cup, which are formed usually at 4 to 6 portions circumferentially during the drawing process due to anisotropy of metallic sheets, and, therefore, the earing portion is extended thin and torn off the cup into fragments. Accordingly, the next coming cup is often redrawn with a tool having the fragments sticking thereon, and in such a case, the fragments are embedded in the sidewall portion of the redrawn cup, and the portion of the sidewall portion where the fragments are embedded becomes extremely thin in the process of ironing. Therefore, the sidewall portion tends to develop small holes therein, or completely rupture circumferentially due to tension incidental to the ironing.

SUMMARY OF THE INVENTION

The object of the present invention is to provide an apparatus for redrawing and ironing a drawn cup, which can prevent earing portions from being exerted excessively high pressure thereon so that the earing portions may not be extended thin and torn off the cup into fragments.

According to the invention, there is provided a redrawing-ironing apparatus comprising a punch fixed on the nose of a ram; a die means including a redrawing die and a plurality of ironing dies for forming a can body from a drawn cup in a cooperative operation with the punch, a holding ring for the redrawing die and a plurality of holding rings for the ironing dies which are piled with a plurality of spacers therebetween; an annular piston for fastening the die means which is provided circumferentially to abut on the end surface of the redrawing die holding ring; a cup retainer pad adapted to push the inner periphery of the bottom of the drawn cup placed on the redrawing die; and a plurality and predetermined length of pins fixed on the annular piston and extending in the axial direction of the die means, wherein a free end surface of the pin is engaged with a flange of the cup retainer pad at the end of a redrawing process, thereby preventing a clearance between the redrawing die and the cup retainer pad from becoming less than a given value.

The above and other objects, features and advantages of the invention will be apparent from the following description when the same is read in conjunction with the accompanying drawings.

DETAILED DESCRIPTION OF THE PREFERRED EMBODIMENT

Figure 1:
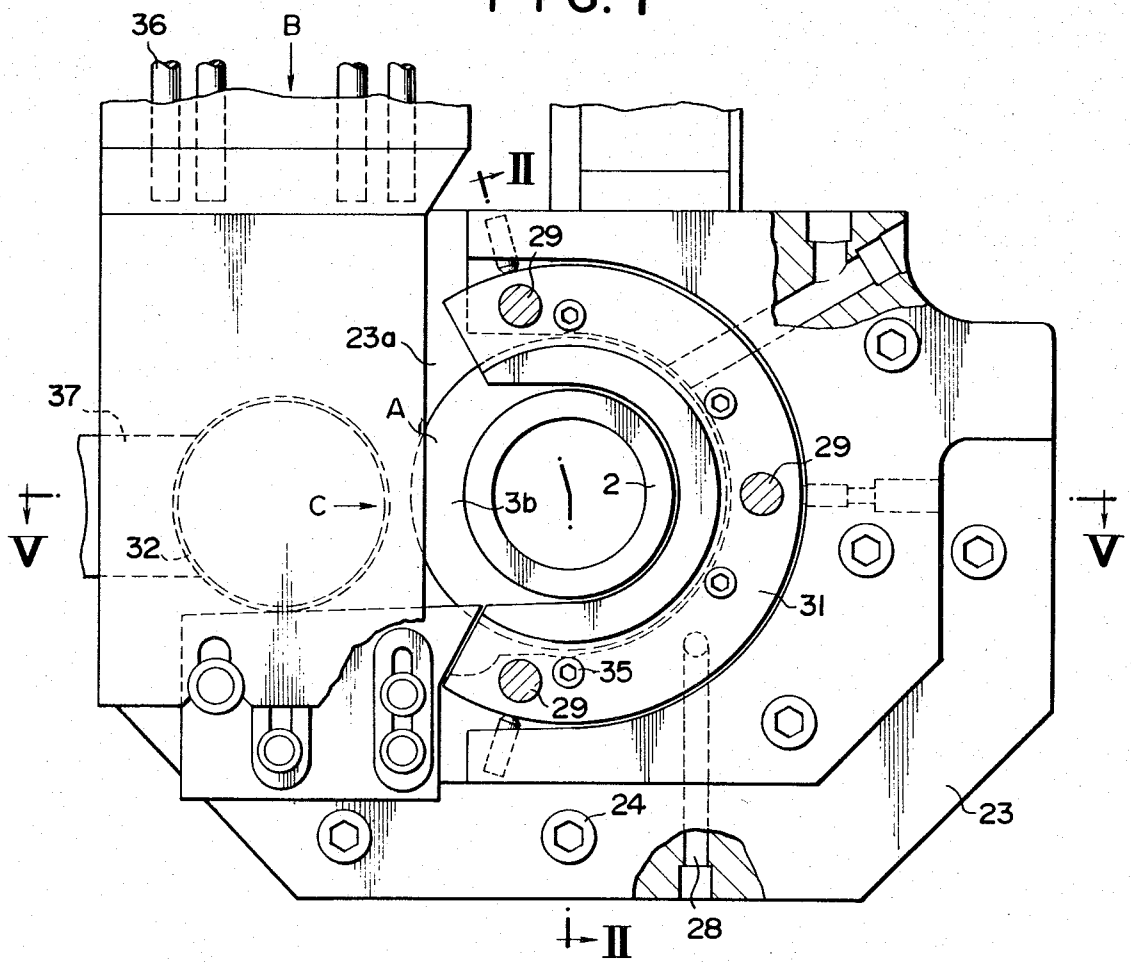
FIG. 1 is an inlet side view of one embodiment of a redrawing-ironing apparatus according to the invention.
Figures 2, 2A:
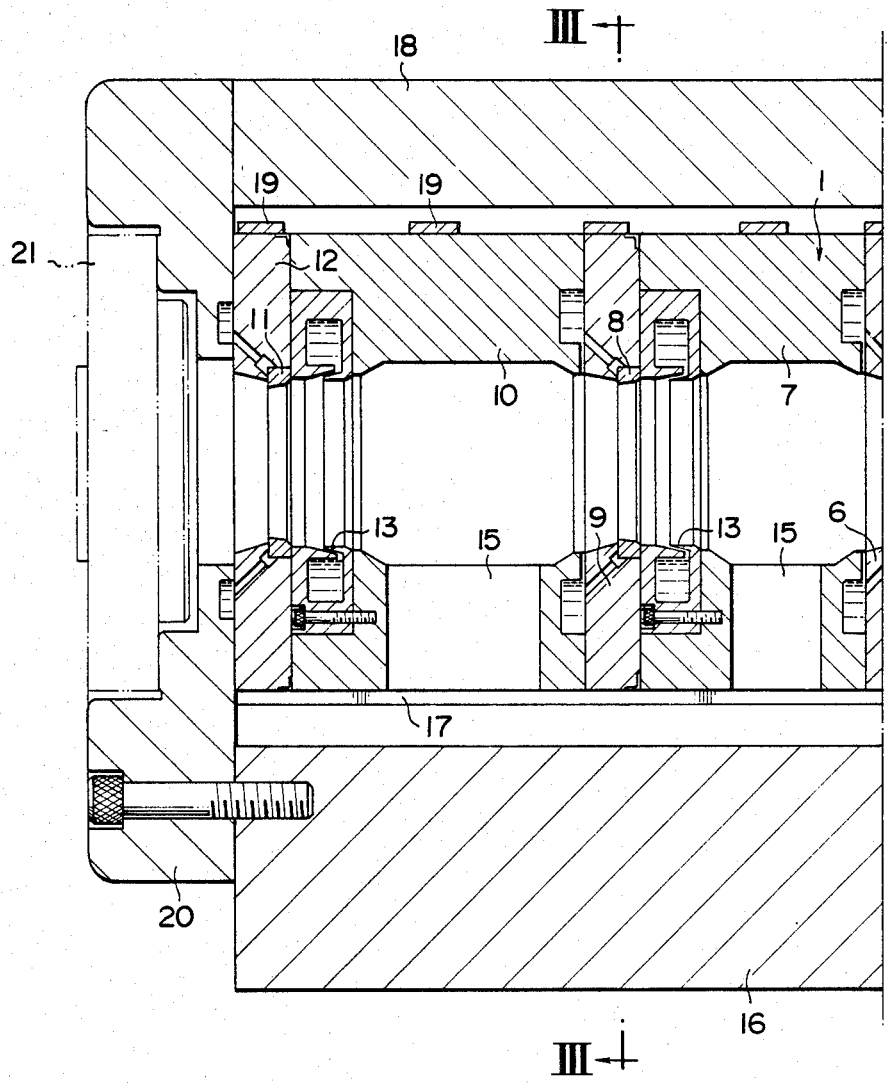
FIGS. 2A and B comprise a vertical sectional view taken on the line II—II of FIG. 1, representing a die means and a retainer pad device.
Figure 2B:
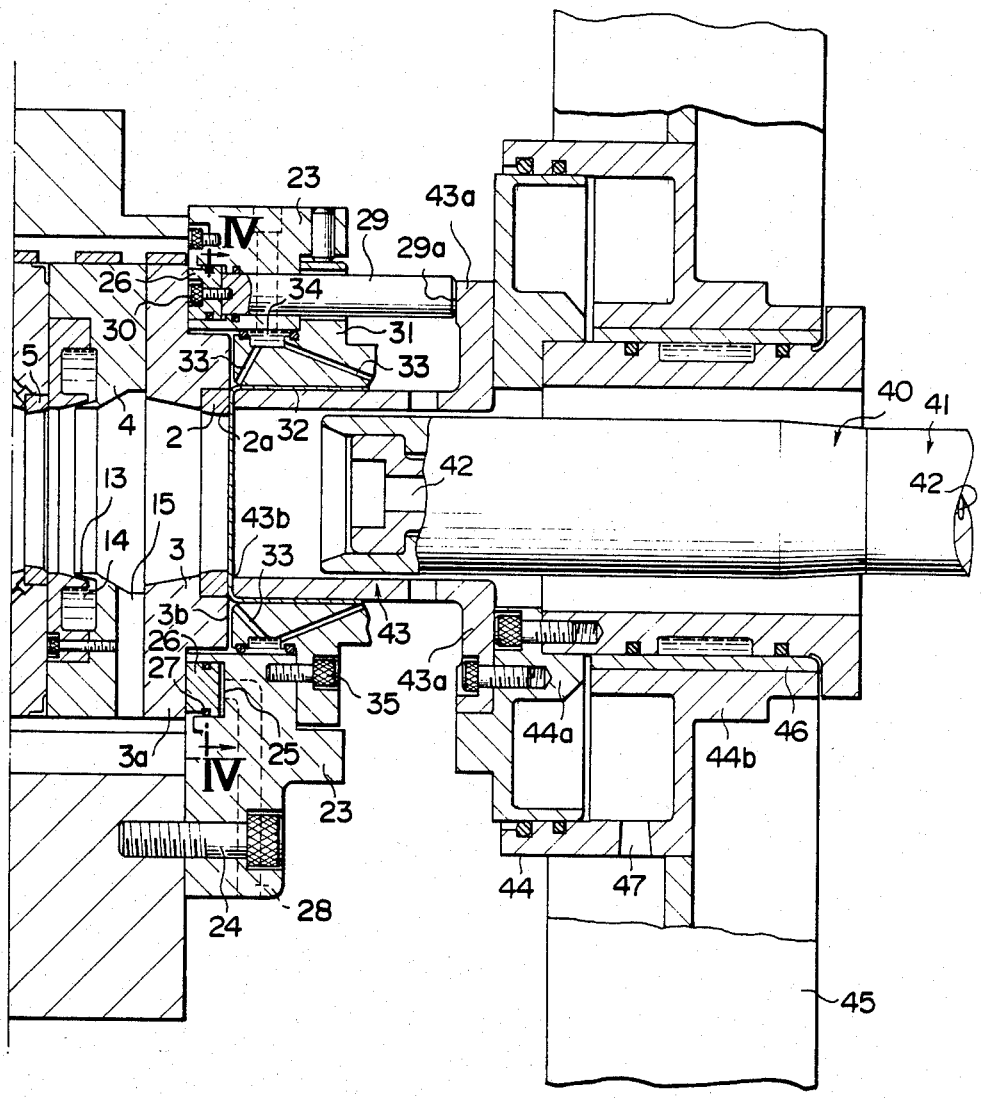

Referring to FIG. 1 and FIG. 2, the die means 1 consists mainly of a holding ring 3 of a redrawing die 2, a first spacer 4, a holding ring 6 of a first ironing die 5, a second spacer 7, a holding ring 9 of a second ironing die 8, a third spacer 10, and a holding ring 12 of a third ironing die 11. A numeral 13 denotes a nozzle for a cooling lubricant 14, and 15 denotes a discharge hole for the cooling lubricant injected through the nozzle 13.

Figure 3:
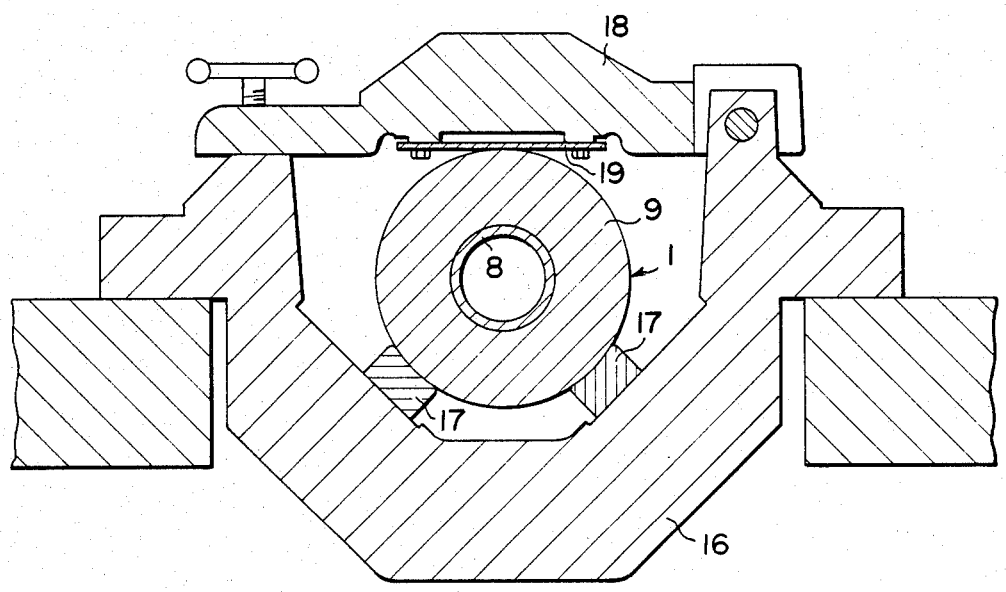
FIG. 3 is a vertical sectional view representing a mounted state of the die means which is taken on line III—III of FIG. 2.

As shown in FIG. 3, the die means 1 is placed on two pieces of rails 17 fixed on a housing 16 and pushed by a leaf spring 19 fixed on a cover 18 which is installed hingedly on the housing 16, thus being supported at three points. A base plate 20 which is fixed on the housing 16 receives a stripper 21 having fingers (not shown) for stripping out an ironed can body from the punch 40.

Figure 4:
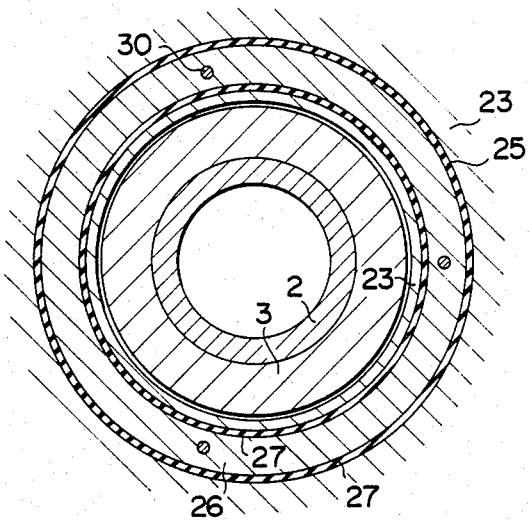
FIG. 4 is a vertical sectional view taken on line IV—IV of FIG. 2, representing the structure of an annular piston.

A cylinder plate 23 is fixed on the housing 16 with a bolt 24. There is formed an annular air cylinder 25 in the cylinder plate 23 along a flange 3*a* of the redrawing die holding ring 3, and as shown in FIG. 2 and FIG. 4, an annular piston 26 with an O-ring 27 is enclosed in the air cylinder 25 so that it comes in contact with an end surface 3*a'* of the flange 3*a*.

A pressure air is supplied to the air cylinder 25 through a hole 28 and a piping (not illustrated). The holding rings 3, 6, 9, 2 and the spacers 4, 7, 10 are pushed and so fastened to the base plate 20 by the annular piston 26. Demounting or remounting of the holding rings or the spacers can be done far easily as compared with a conventional case wherein the fastening is done with bolts or the like, by opening the cover 18 and depressurizing the air cylinder 25 to release the annular piston 26 from pushing and fastening.

A given length and a plurality of pins 29 extending axially (3 pieces in case of the drawing) are fixed on the annular piston 26. The function of the pins 29 will be described later.

Figure 5:
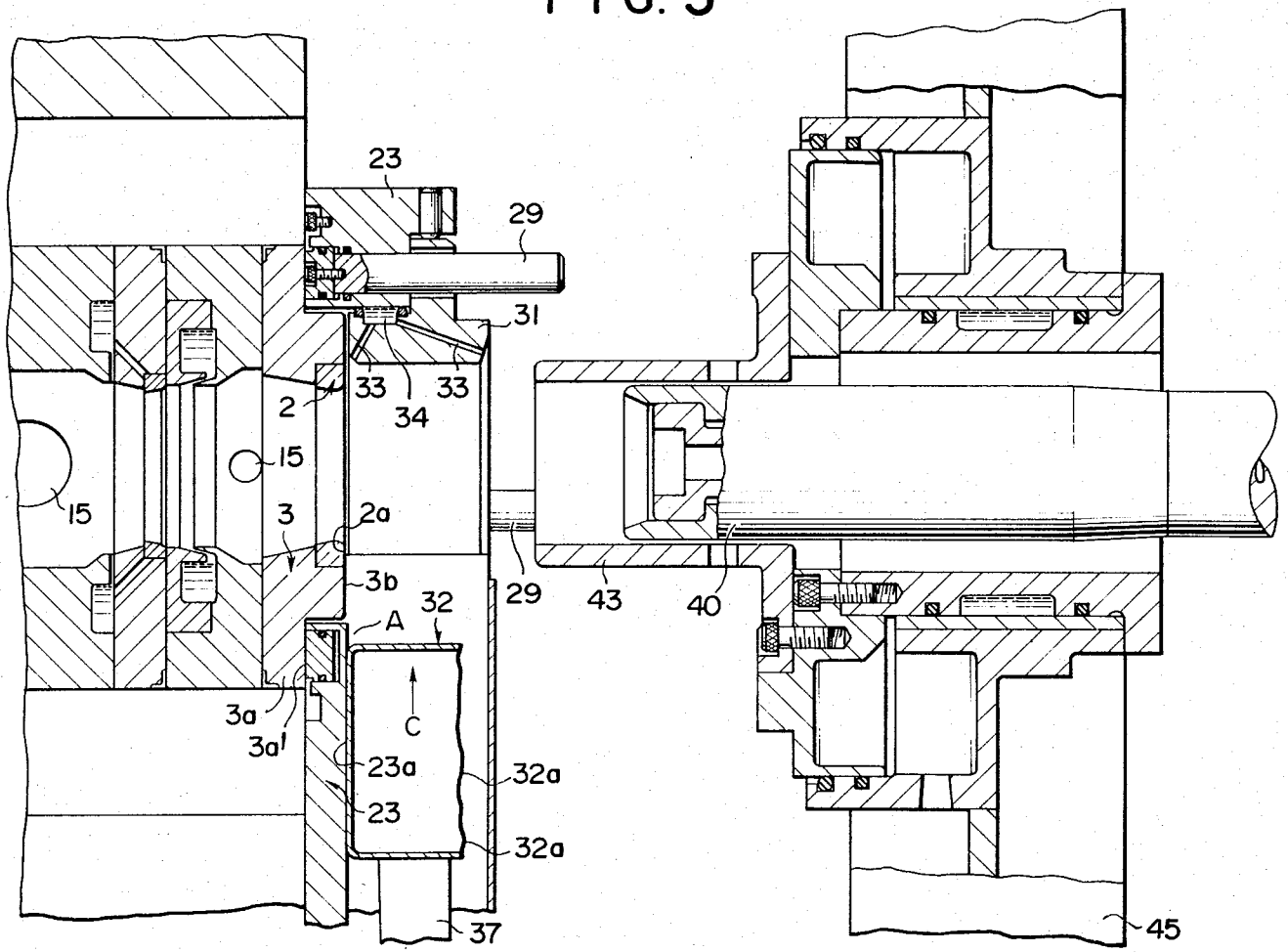
FIG. 5 is a transverse sectional view taken on line V—V of FIG. 1, representing a redrawing die and its vicinity.

A cup holder 31 is fixed on the cylinder plate 23 with bolts 35. As shown in FIG. 1 and FIG. 5, the cup holder 31 is of a short cylindrical form with a feed side A open, and its inside diameter is specified to be almost equal to an outside diameter of the drawn cup 32 to be held therein and redrawn. A numeral 33 denotes a nozzle for injecting a cooling lubricant 34 onto the outside of the sidewall portion of the drawn cup 32.

As will be apparent from FIG. 1 and FIG. 5, the outside 23*a* of the cylinder plate 23 on the feed side A of the drawn cup 32 is formed so as to be of the same plane as the outside 3*b* of the redrawing die holding ring 3 which is on the same plane as the outside 2*a* of the redrawing die 2. The drawn cup 32 can therefore be fed smoothly.

In case the outside 2*a* of the redrawing die and the outside 3*b* of the redrawing die holding ring are aligned with the end surface 3*a'* of the flange 3*a* so as to simplify the structure of the redrawing die holding ring 3, since the drawn cup 32 will be afloat axially when it comes near the redrawing die 2, the drawn cup 32 comes to bounce due to the pressures of the cooling lubricant injected through the nozzle 33 and of air blown out of a hole 42 of the punch 40 which will be described later, the center thereof is dislocated, and thus the drawn cup 32 tends to be crushed by a retainer pad 43 described later. However, such a trouble will not be caused in the case of this embodiment.

Then, the drawn cup 32 is guided by a cage 36 (refer to FIG. 1) to descend on gravity in the direction indicated by an arrow B, and after reaching the position indicated in FIG. 1 and FIG. 5, it is fed in the direction indicated by an arrow C by a shuttle 37 and placed on the redrawing die 2. The punch 40 is fixed on the nose of the ram 41, and the ram 41 is reciprocated axially by a crank mechanism (not illustrated). A hole 42 passes through the punch 40 and the ram 41, and pressure air is blown out of the punch nose at all times through the hole 42. The pressure air is so fed as to make the ironed can body easily come out of the punch 40 in the stripper 21.

A hollow cylindrical retainer pad 43 functions to prevent wrinkles from arising on the drawn cup 32 during redrawing and is specified to have the inside diameter slightly larger than the outside diameter of the punch 40, and the outside diameter a little smaller than the inside diameter of the drawn cup 32. The retainer pad 43 is fixed on a sliding portion 44*a* of an annular air cylinder 44 via its flange 43*a*. A supporting portion 44*b* of the annular air cylinder 44 is fixed on a support wing 45, and the sliding portion 44*a* is adapted to be slidable along a bushing 46 of the supporting part 44*b*. The pressure air is supplied into the annular air cylinder 44 through a piping (not illustrated) by way of a hole 47. The support wing 45 is reciprocated axially at a given timing by a cam mechanism (not illustrated) driven by a crank mechanism (not illustrated) which drives the ram 41.

The height of the pin 29 is specified so that the end surface 29*a* of the pin 29 will be engaged with the flange 43*a* of the retainer pad 43, when the clearance between the outside surface 2*a* of the redrawing die 2 and the nose surface 43*b* of the retainer pad 43 is kept preferably at about $(0.5\sim0.9)\times t$ (t being a thickness of the bottom of the drawn cup 32), thus leaving the above clearance not less than the above value. Therefore, at the end of the redrawing step, the earings 32*a* (FIG. 5) of the drawn cup 32 will never be thinner than the value $(0.5\sim0.9)\times t$ or so, and thus the fragments mentioned above can be prevented from generating. Further, with the height of the pin 29 as above, the above clearance will not develop greater than the thickness t of the bottom of the drawn cup 32 due to the engagement of the pin 29 with the flange 43*a*, and, therefore, the retainer pad 43 will be left powerful enough to suppress occurrence of the wrinkles.

Redrawing-ironing and particularly redrawing are carried out on the above apparatus as follows:

First, the drawn cup 32 which have descended on gravity by way of the cage 36 shown in FIG. 1 is placed on the redrawing die 2 by the shuttle 37. At this point of time, the punch 40 and the nose of the retainer pad 43 are positioned rightward from the cup holder 31 so as not to prevent feeding of the drawn cup 32, as shown in FIG. 5. Subsequently, a support wing 45 goes leftward, the nose surface 43*b* of the retainer pad 43 comes in contact with the inside of the drawn cup 32, and thus the inside is pushed under air pressure by the annular air cylinder 44 (the state given in FIG. 2). At this point of time, there is left a clearance of about $(0.1\sim0.5)\times t$ between the pin 29 and the flange 43*a*. The punch 42 then goes leftward to redraw, and at the point of time when the drawn cup (not illustrated) has passed the redrawing die 2, the end surface 29*a* of the pin 29 is engaged with the flange 43*a*. The ironing process then ensues.

The advantage that the pin 29 is fixed directly on the annular piston 26 is as follows: The die holding rings 3, 6, 9, 12 and the spacers 4, 7, 10 are often replaced owing to wear and failure of the dies. However, a dimensional accuracy of the thickness of each holding ring and spacer is about $0\sim+0.02$ mm. Therefore, a dispersion at about $+0.02$ mm$\times7$ maximum (7 being a total number of the holding rings and spacers)$=+0.14$ mm will arise on overall thickness of the die means 1.

In case the pin 29 is fixed on the annular piston 26, the dispersion will not affect the clearance between the outside surface 2*a* of the redrawing die and the nose surface 43*b* of the retainer pad when the pin 29 is engaged with the flange 43*a*. However, in case the pin 29 is fixed on the housing 16, or the cylinder plate 23, or the cup holder 31, the above dispersion will be influential directly to the above clearance.

Since the thickness t of the bottom of the drawn cup 32 is usually about $0.3\sim0.4$ mm, if the above clearance is set at 0.3 mm$\times0.5=0.15$ mm to a specific die means 1 when the thickness t is 0.3 mm, then a replacement of the die means may cause the above clearance to be 0.15 mm$-0.14$ mm$=0.01$ mm owing to the above dispersion. When the clearance is such small as above, there may arise the trouble that the earings 32*a* of the drawn cup 32 are extended thin and broken into fragments.

As described above, in case the die means is fastened by the annular piston, the die holding rings and spacers can be replaced very easily. Further, in case the pin for preventing the clearance between the redrawing die and the retainer pad from being less than a given value is fixed on the annular piston, the above earings trouble will not be incurred from a fluctuation of an overall thickness of the die means due to the above replacement.

What is claimed is:

1. A redrawing-ironing apparatus comprising a punch fixed on the nose of a ram; a die means including a redrawing die and a plurality of ironing dies for forming a can body from a drawn cup in a cooperative operation with the punch, a holding ring for the redrawing die and a plurality of holding rings for the ironing dies which are piled with a plurality of spacers therebetween; an annular piston for fastening the die means which is provided circumferentially to abut on the end surface of the redrawing die holding ring; a cup retainer pad adapted to push the inner periphery of the bottom of the drawn cup placed on the redrawing die; and a plurality and predetermined length of pins fixed on the annular piston and extending in the axial direction of the die means, wherein a free end surface of the pin is engaged with a flange of the cup retainer pad at the end of a redrawing process, thereby preventing a clearance between the redrawing die and the cup retainer pad from becoming less than a given value.

2. Apparatus as claimed in claim 1, wherein the given value is $(0.5 \sim 0.9) \times t$, where t is the thickness of the bottom of the drawn cup.

* * * * *